US005941722A

United States Patent [19]

Chen

[11] Patent Number: 5,941,722

[45] Date of Patent: Aug. 24, 1999

[54] CRIMP CONNECTOR

[75] Inventor: Victor Chen, Taipei, Taiwan

[73] Assignee: Hon Hai Precision Ind. Co., Ltd., Taipei Hsien, Taiwan

[21] Appl. No.: 09/010,381

[22] Filed: Jan. 21, 1998

[30] Foreign Application Priority Data

Jan. 21, 1997 [TW] Taiwan ..... 86201156

[51] Int. Cl.[6] ..... H01R 13/28

[52] U.S. Cl. ..... 439/291

[58] Field of Search ..... 439/284, 290–293, 439/295, 677

[56] References Cited

U.S. PATENT DOCUMENTS

| | | | |
|---|---|---|---|
| 4,734,052 | 3/1988 | Vandame | 439/293 |
| 4,963,102 | 10/1990 | Gettig et al. | 439/291 |
| 5,035,639 | 7/1991 | Kilpatrick et al. | 439/290 |
| 5,577,928 | 11/1996 | Duclos | 439/293 |

*Primary Examiner*—Gary Paumen
*Assistant Examiner*—Briggitte R. Hammond

[57] ABSTRACT

An electrical connector comprises two identical crimp connectors each having an insulative housing and a number of identical conductive contacts received in passageways defined therein. A number of mating devices are formed on front faces of each housing enclosing mating openings of a portion of the passageways, wherein the mating devices are arranged so that each mating opening which is not enclosed by a mating device is adjacent to a mating opening that is enclosed by a mating device. Each contact consists of a crimping portion for retaining the conductive interior of a wire, a retention portion with positioning means for properly positioning and securing the contact within the corresponding passageway of the housing, and an interlocking portion for engagement with a corresponding contact of the other housing. When the two crimp connectors are mated together, the mating devices of one housing are snugly received in the spaces defined between the mating devices of the other housing and the interlocking portions of the contacts of each housing engage with each other to firmly secure the two crimp connectors together.

10 Claims, 5 Drawing Sheets

CRIMP CONNECTOR

BACKGROUND OF THE INVENTION

1. Field of the Invention

The present invention relates to an electrical connector, and more particularly to two identical crimp connectors mated together.

2. The Prior Art

A variety of electrical connectors exist which interconnect terminating ends of electrical circuitry. Such connectors often consist of two insulative housings engaged with each other at one end to connect corresponding wires inserted into each housing from another end. If the wires to be interconnected are of different gauges then two crimp connectors are usually employed to effectively secure the wires within terminal contacts received in passageways defined in each crimp connector. The two crimp connectors are then matingly engaged to provide a secure engagement between the corresponding contacts thereof.

Conventional crimp connectors consist of a male portion having conductive contacts extending therefrom and a female portion receiving conductive contacts in passageways defined therein. Terminal ends of wires to be interconnected are secured to the corresponding contacts and the contacts of the male portion are received in the contacts of the female portion to electrically engage the connector portions together.

Since the male and female connector portions are shaped differently, the molding process thereof requires the use of two different molds which increases manufacturing costs. The contacts of each portion are also formed having a different shape and, therefore, also require different metal stamping techniques thereby further increasing manufacturing costs.

If the two connector portions are engaged having an incorrect orientation, miscommunication between electrical components joined by the connector will result. Some conventional crimp connectors provide anti-disorientation means on each connector portion for preventing improper engagement therebetween but such means generally have a complicated structure thereby further complicating the molding process thereof.

If the contacts of the female portion are not properly inserted within the passageways defined therein, a straining force will be exerted on the contacts of both connector portions when they are engaged thereby causing an intermittent connection therebetween resulting in a miscommunication between the electrical components joined by the connector.

Examples of conventional crimp connectors and their related conductive contacts are disclosed in Taiwan Patent Nos. 78102560 and 79209439, and U.S. Pat. Nos. 4,979,912, 5,032,090, 5,133,672, 5,257,948, 5,342,221, 5,403,204 and 5,456,617.

The disadvantages described above illustrate that a need exists for an improved crimp connector which can eliminate the shortcomings of conventional crimp connectors.

SUMMARY OF THE INVENTION

Accordingly, to resolve the above disadvantages of conventional crimp connectors, an object of the present invention is to provide an improved electrical connector consisting of two identical crimp connectors which can be securely engaged with each other.

Another object of the present invention is to provide an electrical connector having identical contacts formed from the same metal stamping process for reception in passageways defined in each crimp connector.

A further object of the present invention is to provide an electrical connector having anti-disorientation means of a simple structure formed on each crimp connector.

Still another object of the present invention is to provide an electrical connector having a positioning means which will ensure the proper positioning of the contacts inserted in the passageways defined in each crimp connector thereby preventing a straining force from acting on the connected contacts.

According to an aspect of the present invention, an electrical connector comprises two identical crimp connectors each having an insulative housing, and a number of identical conductive contacts. The contacts are received in passageways defined in each housing and extend through mating openings exposed to a first surface thereof. A number of mating devices are formed on the first surface of each housing enclosing a portion of the mating openings of the passageways for providing the electrical connector with anti-disorientation means, wherein the mating devices are arranged so that each mating opening which is not enclosed by a mating device is adjacent to a mating opening that is enclosed by a mating device.

Each contact consists of a crimping portion for retaining a conductive interior of a wire, a retention portion with positioning means for properly positioning and securing the contact within the corresponding passageway of the housing, and an interlocking portion for engagement with the contact of the corresponding crimp connector.

When the two crimp connectors are mated together, the mating devices of one crimp connector are snugly received in the spaces defined between the mating devices of the other crimp connector and the interlocking portions of the contacts of each crimp connector engage with each other to firmly secure the two crimp connectors together.

DETAILED DESCRIPTION OF THE PREFERRED EMBODIMENTS

Reference will now be made in detail to the preferred embodiments of the present invention. To facilitate understanding, like parts will be labeled with the same numeral throughout the description.

Figure 1:
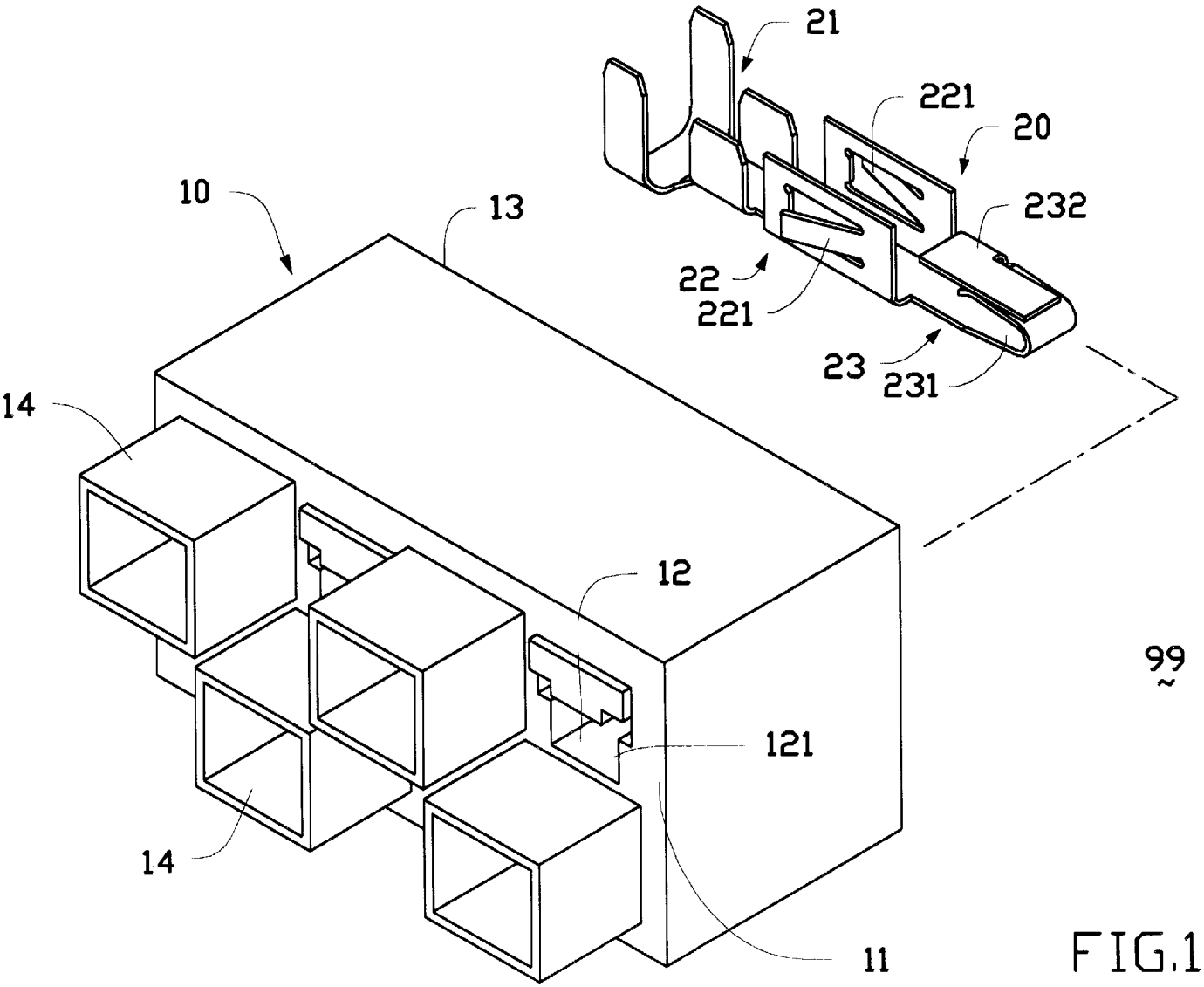
FIG. 1 is a perspective view of a housing and a contact of a crimp connector in accordance with the present invention.

Referring to FIG. 1, a crimp connector 99 in accordance with the present invention includes an insulative housing 10 and a number of conductive contacts 20 (only one shown). The housing 10 has a first surface 11, a second surface 13, and a number of passageways 12 defined therebetween for receiving the contacts 20 therein. The contacts 20 extend through mating openings 121 of the passageways 12 exposed to the first surface 11 of the housing 10.

A number of mating devices 14 are formed on the first surface 11 of the housing 10 enclosing a portion of the mating openings 121 of the passageways 12 for providing the crimp connector 99 with anti-disorientation means. The mating devices 14 are arranged so that each mating opening 121 which is not enclosed by a mating device 14 is adjacent to a mating opening 121 that is enclosed by a mating device 14.

Figure 2:
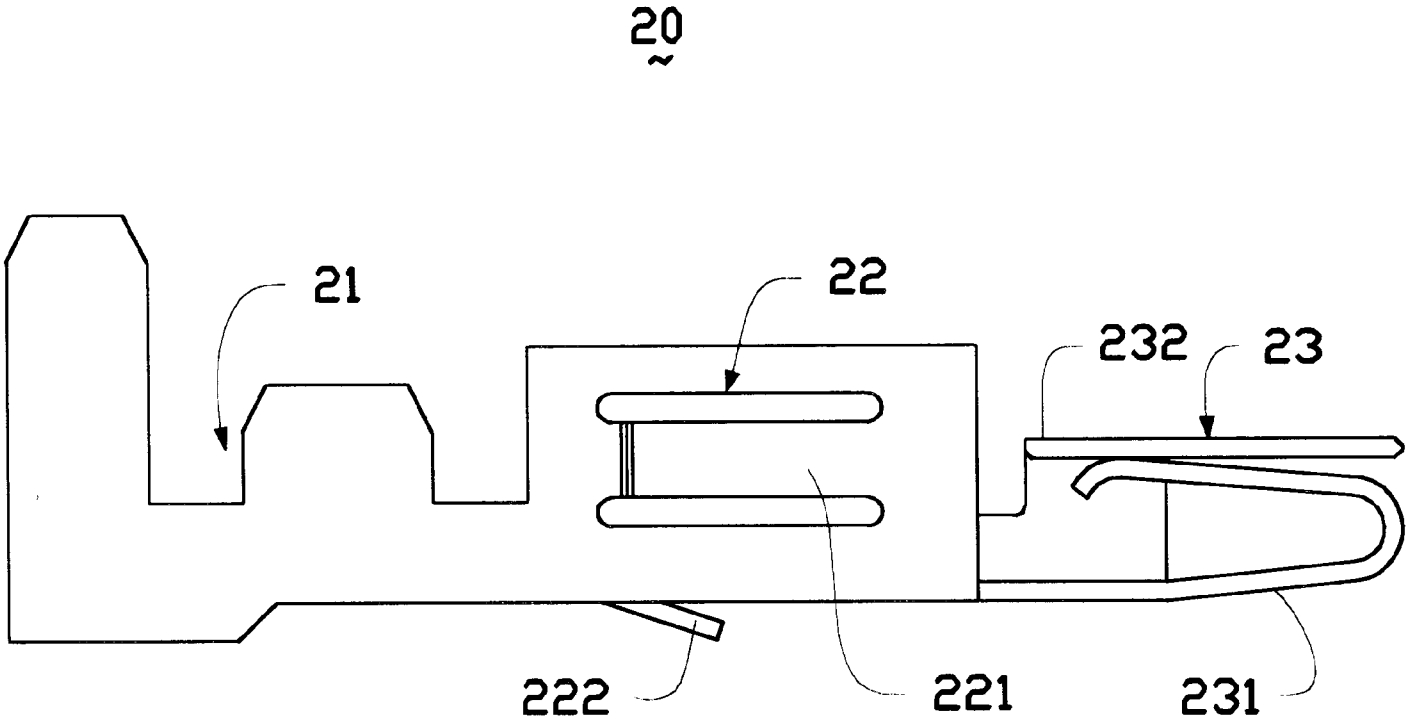
FIG. 2 is a side elevational view of one contact of the crimp connector in accordance with the present invention.
Figure 5:
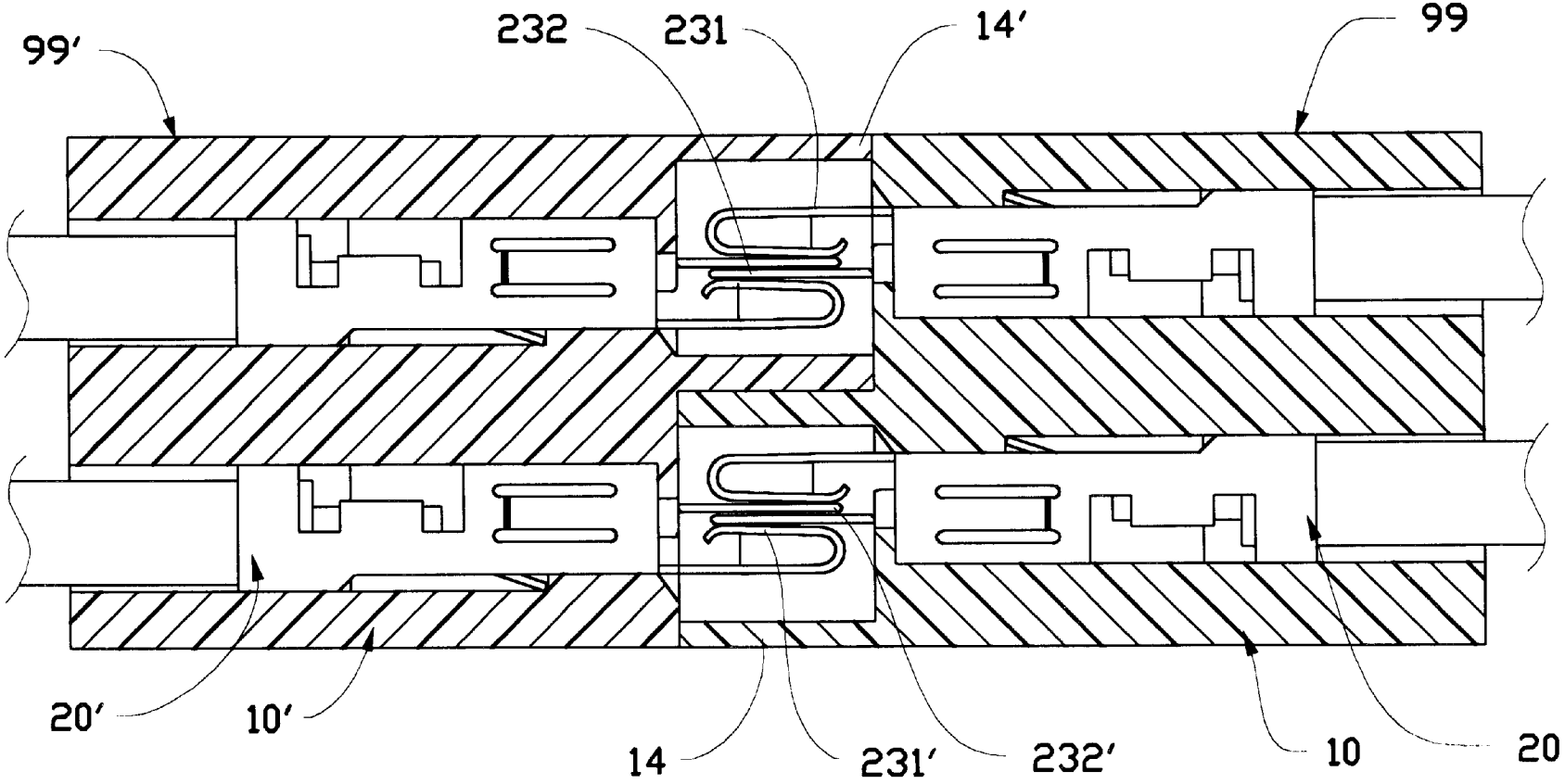
FIG. 5 is a cross-sectional view of FIG. 4.

Also referring to FIG. 2, each contact 20 consists of a crimping portion 21 for receiving a conductive interior of a wire (not shown), a retention portion 22 with positioning means (not labeled) for properly positioning and securing the contact 20 within the passageway 12 of the housing 10, and an interlocking or engagement portion 23 for engagement with a contact 20' of a corresponding crimp connector 99' (shown in FIG. 5). The positioning means of the retention portion 22 20 includes two laterally extending protrusions 221 and an outwardly extending barb 222 for reception in three recesses (not shown) defined in inner walls of the passageways 12, respectively. The interlocking portion 23 includes a flexible U-shaped retainer 231 which abuts a flat plate 232.

Figure 3:
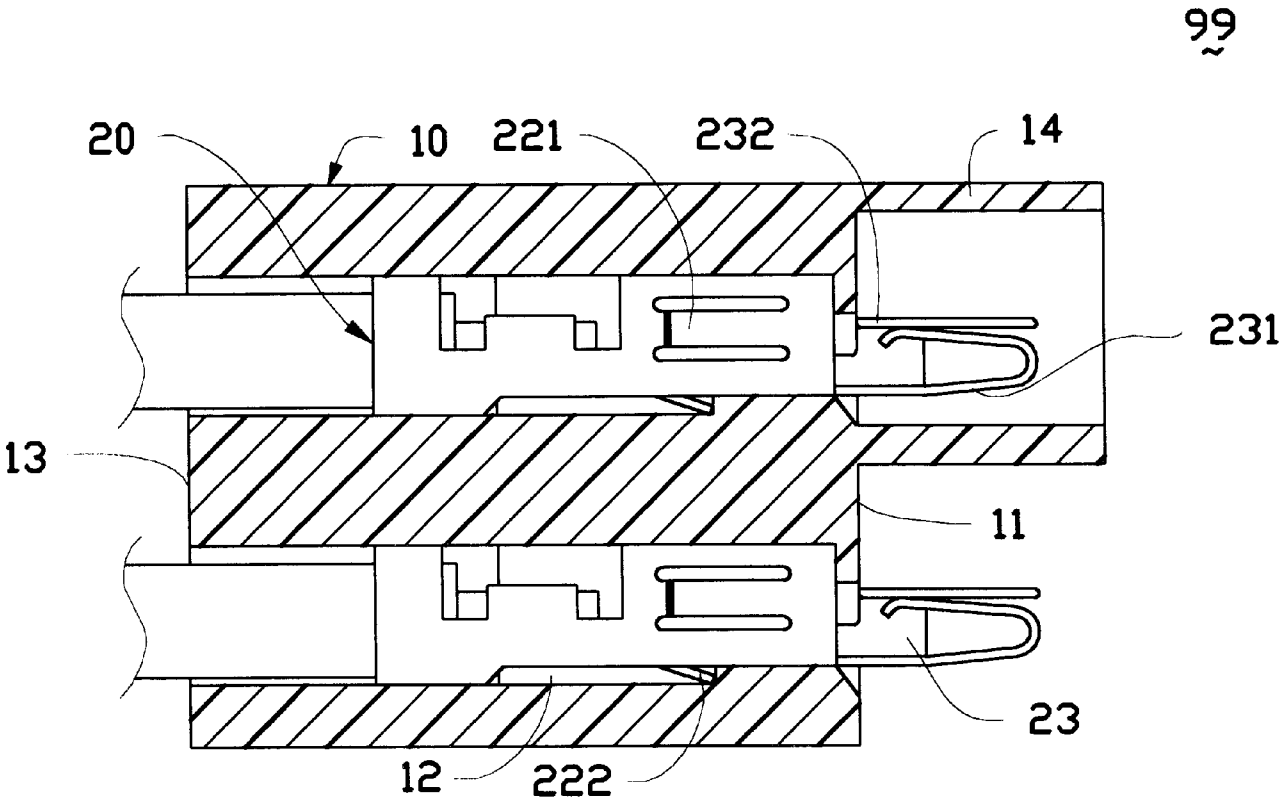
FIG. 3 is a cross-sectional view of the housing of the crimp connector with contacts received in passageways defined therein in accordance with the present invention.

In assembly, referring to FIG. 3, the conductive interior of each wire (not labeled) is retained in the crimping portion 21 of the corresponding contact 20. The contact 20 together with the crimped wire is then inserted into the corresponding passageway 12 of the housing 10 from a second surface 13 thereof. The protrusions 221 and the barb 222 of the retention portion 22 of the contact 20 are respectively received in the recesses (not labeled) defined in the inner walls of each passageway 12 of the housing 10 thereby properly positioning and firmly securing the contact 20 therein. The interlocking portions 23 of each contact 20 extend through the mating openings 121 beyond the first surface 11 of the housing 10, whereby each interlocking portion 23 is either exposed to an outside thereof or is received within one of the mating devices 14.

Figure 4:
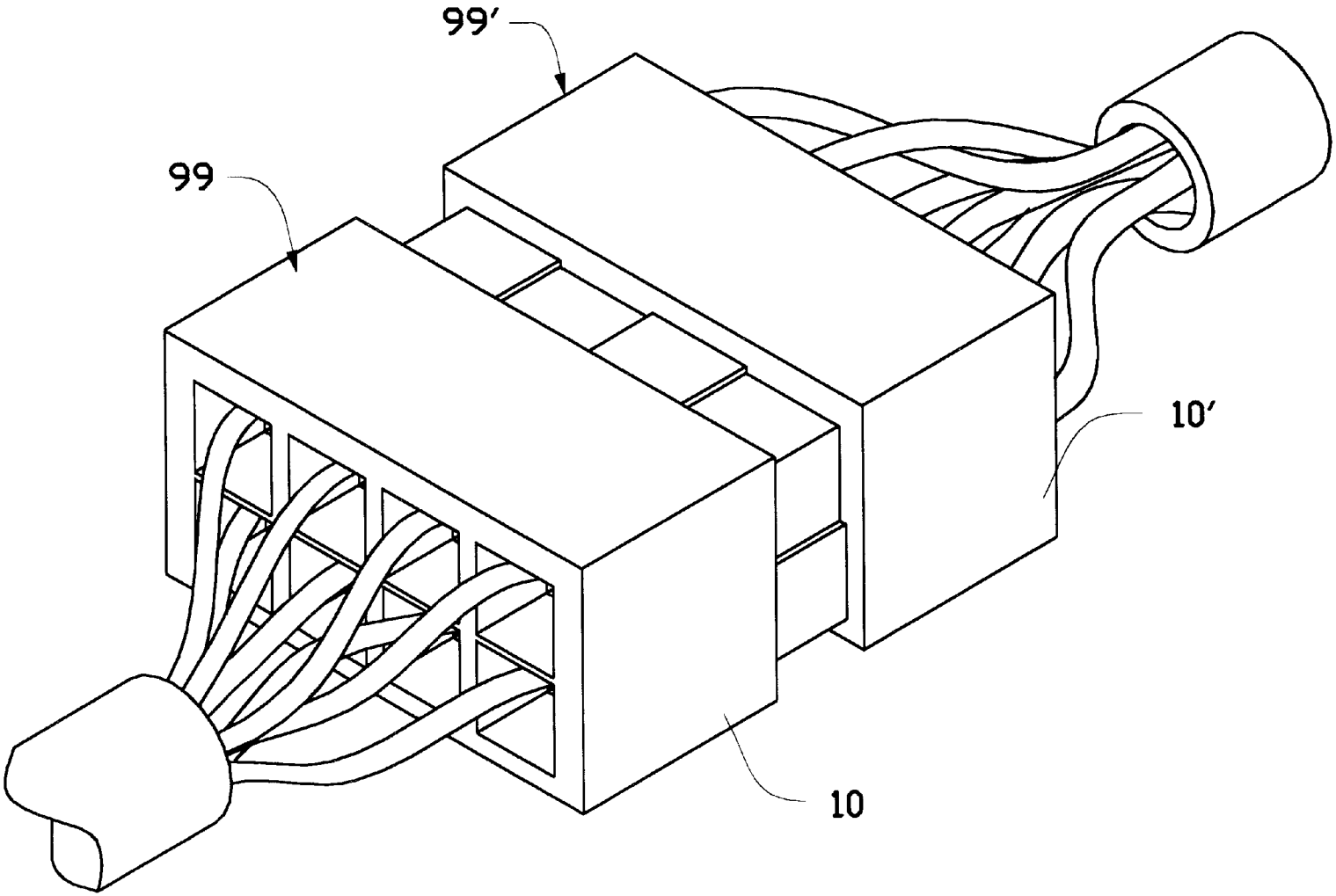
FIG. 4 is an assembled perspective view of two identical crimp connectors in accordance with the present invention.

Referring to FIGS. 4 and 5, when the crimp connectors 99, 99' are mated together, the mating devices 14 of the housing 10 are snugly received in the spaces defined between mating devices 14' of housing 10' and the interlocking portions 23 of the contacts 20 engage with interlocking portions 23' of the contacts 20'. Due to the arrangement of the mating devices 14, 14' the housings 10, 10' can only be engaged having one orientation, therefore the mating devices 14, 14' constitute the anti-disorientation means of the electrical connector. The plate 232 of the contact 20 is sandwiched between a plate 232' and a retainer 231' of the contact 20' by a resilient force of the retainer 231' acting on the plate 232. Likewise, the plate 232' of the contact 20' is sandwiched between the plate 232 and the retainer 231 of the contact 20 thereby firmly securing the interlocking portions 23, 23' of the contacts 20, 20' together. The snug fit of the mating devices 14, 14' combined with firm engagement of the interlocking portions 23, 23' ensure a secure connection between the two crimp connectors 99, 99'.

The improved electrical connector in accordance with the present invention facilitates the cost effective manufacture and time efficient assembly thereof by disclosing two identical crimp connectors 99, 99' each having positioning means and anti-disorientation means. Thus, the present invention is novel and advantageous over the prior art, and qualifies to be granted a patent.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

I claim:

1. An electrical connector assembly comprising:

two identical crimp connectors each having;

an insulative housing, each housing having a first surface, a second surface, a plurality of passageways defined between the first and second surfaces, a mating opening at the end of each of said passageways exposed to the first surface, and anti-disorientation means formed on the first surface; and a plurality of conductive contacts received in the passageways of each housing, each contact including a crimping portion for retaining a conductive interior of a wire, a retention portion with positioning means for properly positioning and securing the contact within the passageway of the housing, and an interlocking portion for engagement with a corresponding contact of the other housing, wherein the anti-disorientation means includes a plurality of mating devices formed on the first surface enclosing a portion of a respective one of some of the mating openings, remaining ones of the mating opening not being enclosed by a mating device.

2. The connector assembly as described in claim 1, wherein said mating devices are arranged so that each mating opening which is not enclosed by a mating device is adjacent to a mating opening that is enclosed by a mating device.

3. The connector assembly as described in claim 2, wherein when the two identical crimp connectors are mated together, the mating devices of one housing are snugly received in the spaces defined between mating devices of the other housing.

4. The connector assembly as described in claim 1, wherein said positioning means consists of two laterally extending protrusions and an outwardly extending barb formed on the retention portion of each contact for reception in three recesses defined in inner walls of the passageways, respectively.

5. The connector assembly as described in claim 1, wherein the interlocking portion includes a flexible U-shaped retainer which abuts a flat plate, said flat plate and said retainer sandwiching therebetween the flat plate of a corresponding contact of the other crimp connector when the two crimp connectors are mated together.

6. The connector assembly as described in claim 1, wherein said interlocking portions of said contacts extend beyond the first surface of the housing.

7. The connector assembly as described in claim 1, wherein said interlocking portions of said contacts are received in the mating devices of the housing.

8. In combination a first and a second mating connector, each of said connectors comprising an insulative housing, said housing defining a first surface and a second surface with a plurality of passageways extending therebetween, a mating opening positioned at one end of each of said passageways and exposed to the first surface, a plurality of mating devices formed on said first surface in a generally staggered arrangement each mating device substantially enclosing a portion of a respective one of some of the mating openings of said passageways while leaving remaining one of the mating openings with out mating devices, whereby when the first and the second connectors mate with each other, the mating devices of the first connector confront the portion of the mating openings of the passageways of the second connector which do not have mating openings enclosed by the mating devices of the second connector, and at the same time, the mating devices of the second connector confronts the portion of the mating openings of the passageways of the first connector which do not have mating openings enclosed by the mating devices of the first connector, and thus the mating devices of the first connector and the mating devices of the second connector may engage with each other in a lateral direction relative to a mating direction along said passageways.

9. The combination as defined in claim 8, wherein the mating devices of each of said connectors are arranged so that each mating opening which is not enclosed by the mating device is adjacent to the mating opening that is enclosed by the mating device.

10. A connector assembly consisting of a first and a second mating connector, each of said connectors comprising an insulative housing, said housing defining a first surface and a second surface with a plurality of passageways extending therebetween, a mating opening positioned at one end of each of said passageways and exposed to the first surface, a number of contacts received in the corresponding passageways, each of said contacts including an engagement portion protruding out of the first surface, a plurality of mating devices formed on said first surface and enclosing a portion of a respective one of some of the mating openings of said passageways and substantially enclosing the engagement portions of the corresponding contacts in said same passageways, whereby when the first and the second connectors mate with each other, the mating devices of the first connector confront the portion of the mating openings of the passageways of the second connector which do not have mating openings enclosed by the mating devices of the second connector, and thus said mating devices of the first connector substantially enclose the engagement portions of the corresponding contacts of the second connector which have no mating devices thereof to be received in; and at the same time, the mating devices of the second connector confront a remaining portion of the mating openings of the passageways of the first connector which is not of the mating openings enclosed by the mating devices of the first connector, and thus the mating devices of the second connector substantially enclose the engagement portions of the corresponding contacts of the first connector which have no mating devices thereof to be received in.

* * * * *